US008113762B2

(12) United States Patent
Belik

(10) Patent No.: US 8,113,762 B2
(45) Date of Patent: Feb. 14, 2012

(54) HORIZONTAL PIPE STORAGE AND HANDLING SYSTEM

(75) Inventor: Jaroslav Belik, Pearland, TX (US)

(73) Assignee: National Oilwell Varco, L.P., Houston, TX (US)

( * ) Notice: Subject to any disclaimer, the term of this patent is extended or adjusted under 35 U.S.C. 154(b) by 265 days.

(21) Appl. No.: 11/870,637

(22) Filed: Oct. 11, 2007

(65) Prior Publication Data

US 2008/0101891 A1 May 1, 2008

Related U.S. Application Data

(60) Provisional application No. 60/862,812, filed on Oct. 25, 2006.

(51) Int. Cl.
*B66F 11/00* (2006.01)
*E21B 19/00* (2006.01)

(52) U.S. Cl. ..... 414/746.4; 414/22.62

(58) Field of Classification Search ..... 175/52, 175/85; 211/70.4; 414/22.51–22.56, 22.62–22.63, 414/22.65, 22.68–22.69, 745.1, 745.4–745.6, 414/745.9, 746.1–746.2, 746.4
See application file for complete search history.

(56) References Cited

U.S. PATENT DOCUMENTS 278,022 A 5/1883 Kline
845,152 A * 2/1907 Weir ..... 83/722
2,631,741 A 3/1953 Tucker
2,710,104 A 6/1955 Putnam
3,062,389 A * 11/1962 Hunter ..... 414/746.2
3,182,816 A 5/1965 Illo
3,254,776 A * 6/1966 Brown ..... 414/22.61
3,315,822 A * 4/1967 Wilson ..... 414/22.59
3,365,085 A * 1/1968 Wilson ..... 414/471
3,559,821 A 2/1971 James
3,706,347 A 12/1972 Brown
3,717,270 A * 2/1973 Rooke et al. ..... 414/414
3,734,208 A 5/1973 Otto (Continued)

FOREIGN PATENT DOCUMENTS

WO 01/51762 A1 7/2001

(Continued)

OTHER PUBLICATIONS

EPO Search Report dated Mar. 28, 2008, for EPO Patent Application No. 07118892.4.

(Continued)

*Primary Examiner* — Gregory Adams
(74) *Attorney, Agent, or Firm* — Conley Rose, P.C.

(57) ABSTRACT

This application relates to a pipe storage and handling system having a stationary frame, a tilting frame moveably coupled to the stationary frame, a pipe rack moveably coupled to the tilting frame and an arm. The pipe rack includes a storage end configured to support a plurality of pipes. The tilting frame includes a loading end and is moveable between a loading position where the loading end is positioned at a higher elevation than the storage end and an unloading position wherein the storage end is positioned at a higher elevation than the loading end. The system includes an arm to engage a single pipe and move the single pipe onto or off of the tilting frame. The pipe rack may move the pipes vertically relative to the tilting frame. The pipe rack may support a cartridge for retaining the pipes. The system may include a pipe erector.

21 Claims, 10 Drawing Sheets

U.S. PATENT DOCUMENTS

| | | | | | |
|---|---|---|---|---|---|
| 3,734,210 | A | | 5/1973 | Wilderman | |
| 3,792,783 | A | | 2/1974 | Brown | |
| 3,916,500 | A | | 11/1975 | Brown | |
| 3,985,221 | A | | 10/1976 | Lueders | |
| 4,051,956 | A | * | 10/1977 | Teague | 414/746.4 |
| 4,106,635 | A | * | 8/1978 | Nishimura | 414/796.3 |
| 4,380,297 | A | * | 4/1983 | Frias | 211/70.4 |
| 4,494,899 | A | | 1/1985 | Hoang et al. | |
| 4,533,055 | A | * | 8/1985 | Haney | 211/70.4 |
| 4,604,724 | A | * | 8/1986 | Shaginian et al. | 700/213 |
| 4,642,017 | A | | 2/1987 | Fenn | |
| 4,773,547 | A | * | 9/1988 | Bell | 211/194 |
| 4,802,810 | A | * | 2/1989 | Gunn | 414/414 |
| 5,769,597 | A | * | 6/1998 | Tsune | 414/746.2 |
| 5,887,816 | A | | 3/1999 | Jones | |
| 6,182,837 | B1 | * | 2/2001 | Crabtree | 211/59.4 |
| 6,311,788 | B1 | * | 11/2001 | Weixler | 175/52 |
| 6,860,694 | B2 | * | 3/2005 | Slettedal | 414/22.51 |
| 2002/0098073 | A1 | * | 7/2002 | Drei et al. | 414/746.2 |
| 2005/0074307 | A1 | * | 4/2005 | Guarisco et al. | 410/36 |
| 2006/0045655 | A1 | | 3/2006 | Wells | |
| 2006/0060382 | A1 | | 3/2006 | Sewell et al. | |
| 2007/0031215 | A1 | | 2/2007 | Belik | |
| 2007/0092358 | A1 | * | 4/2007 | Innes et al. | 414/22.51 |

FOREIGN PATENT DOCUMENTS

| | | | |
|---|---|---|---|
| WO | 2007/041822 | A1 | 4/2007 |

OTHER PUBLICATIONS

U.S. Appl. No. 11/458,527 Restriction Requirement dated Mar. 6, 2008.
U.S. Appl. No. 11/458,527 Office Action dated May 5, 2008.
U.S. Appl. No. 11/458,527 Final Office Action dated Oct. 10, 2008.
U.S. Appl. No. 11/458,527 Office Action dated Feb. 25, 2009.
U.S. Appl. No. 11/458,527 Office Action dated Jun. 26, 2009.

* cited by examiner

HORIZONTAL PIPE STORAGE AND HANDLING SYSTEM

CROSS-REFERENCE TO RELATED APPLICATIONS

The present application claims the benefit of U.S. Provisional Application Ser. No. 60/862,812, filed Oct. 25, 2006, entitled Horizontal Pipe Handling and Storage System.

BACKGROUND

The present invention relates generally to methods and apparatus for drilling wells. More specifically, the present invention relates to systems for drilling wells utilizing single joints of pipe.

Many smaller drilling rigs store tubular members, such as drill pipe, drill collars, and casing, in horizontal storage areas outside of the rig. As the different tubular members are needed, they are brought to the drill floor one at a time and added to the string. Handling these tubular members has historically been a highly manual job using winches or other lifting appliances within the rig. Automated systems for use in these "single joint" rigs must be able to safely handle a variety of tubular members while not slowing down drilling or tripping processes.

One important step in the pipe handling process is manipulating pipe and other tubular members in the horizontal storage areas before they are moved to the drilling rig. In many operations, horizontal pipes are manipulated using forklifts or other manually-operated lifting devices. These manual systems limit the efficiency of the overall system and also often place workers in areas where heavy loads are being moved, thus creating safety concerns. Thus, there remains a need to develop methods and apparatus for pipe handling and drilling systems, which overcome some of the foregoing difficulties while providing more advantageous overall results.

BRIEF DESCRIPTION OF THE DRAWINGS

For a more detailed description of the preferred embodiments of the present invention, reference will now be made to the accompanying drawings, wherein.

SUMMARY

Figure 1:
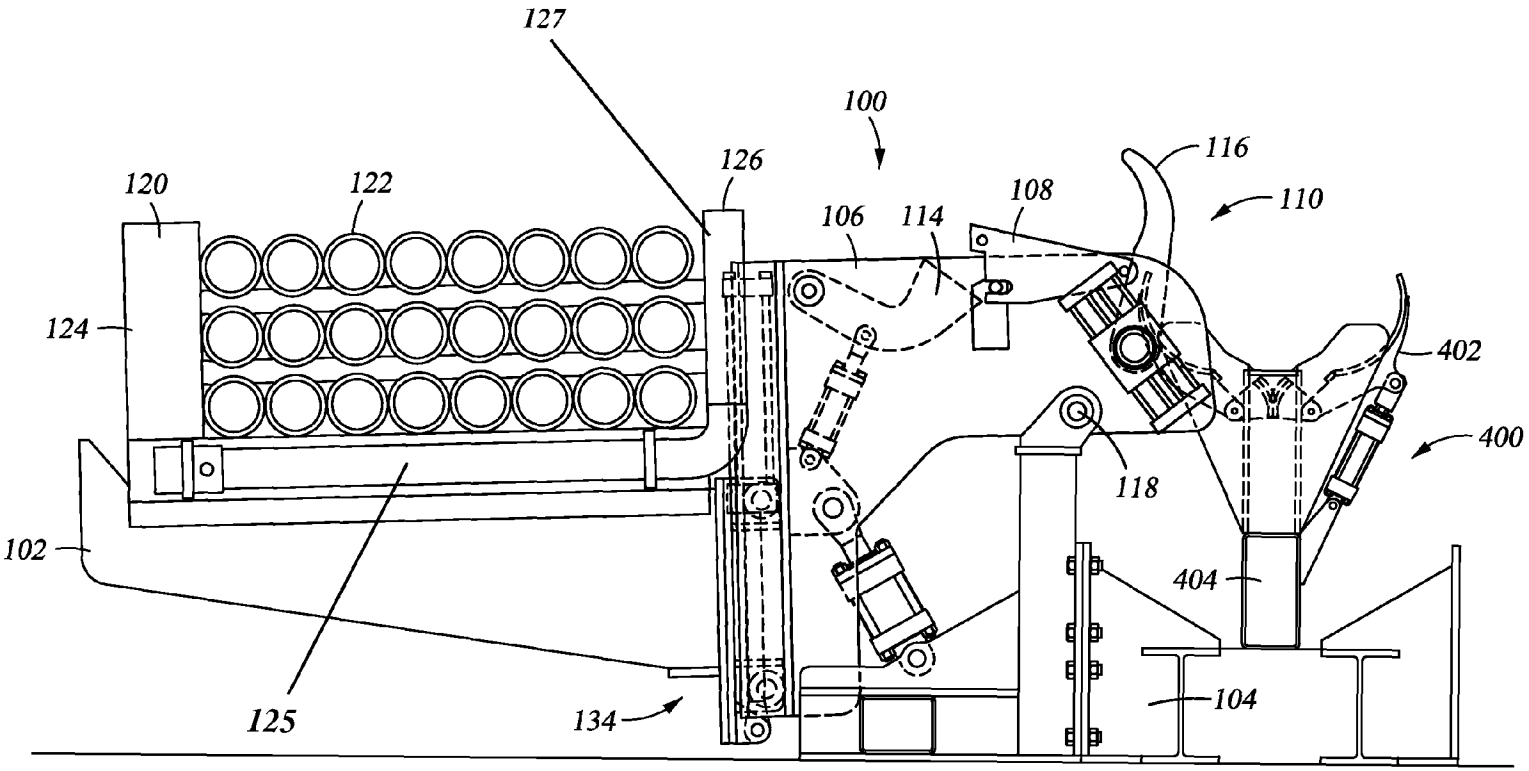
FIG. 1 is a pipe storage and handling system constructed in accordance with embodiments of the present invention.

Embodiments of the present invention include a pipe storage and handling system comprising a stationary frame, a tilting frame moveably coupled to the stationary frame and having a loading end, a pipe rack moveably coupled to the tilting frame and configured to support a plurality of pipes at a storage end, wherein the tilting frame is moveable between a loading position where the loading end is positioned at a higher elevation than the storage end and an unloading position wherein the storage end is positioned at a higher elevation than the loading end, and an arm disposed at the loading end of the tilting frame, wherein the arm is configured to engage a single pipe and move the single pipe onto or off of the tilting frame.

Other embodiments of the present invention include a pipe storage and handling system comprising a pipe erector, a stationary frame disposed adjacent to the pipe erector, a tilting frame moveably coupled to the stationary frame and having a loading end, a pipe rack moveably coupled to the tilting frame and configured to support a plurality of pipes at a storage end, wherein the tilting frame and the pipe rack are moveable to transfer the pipes between the storage end and the loading end, and an arm disposed at the loading end of the tilting frame, wherein the arm is configured to engage a single pipe and move the single pipe onto or off of the pipe erector.

Further embodiments of the present invention include a method for handling pipes comprising storing a plurality of pipes between a storage end of a pipe rack and a loading end of a tilting frame that is moveably coupled to a stationary frame, moving the tilting frame and the pipe rack that is moveably coupled to the tilting frame to an unloading position wherein the storage end is positioned at a higher elevation than the loading end, and rotating an arm disposed at the loading end of the tilting frame so that the arm engages a single pipe and moves the single pipe off of the tilting frame.

Thus, the embodiments of present invention comprise a combination of features and advantages that enable substantial enhancement of moving pipe and other tubular members to and from a drilling rig. These and various other characteristics and advantages of the present invention will be readily apparent to those skilled in the art upon reading the following detailed description and by referring to the accompanying drawings.

DETAILED DESCRIPTION

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Unless otherwise specified, any use of any form of the terms "connect", "engage", "couple", "attach", or any other term describing an interaction between elements is not meant to limit the interaction to direct interaction between the elements and may also include indirect interaction between the elements described. As used herein, pipe may generally refer to various oilfield tubulars, including drill pipe, drill collars, casing, and tubing. In the following discussion and in the claims, the terms "including" and "comprising" are used in an open-ended fashion, and thus should be interpreted to mean "including, but not limited to . . .". The various characteristics mentioned above, as well as other features and characteristics described in more detail below, will be readily apparent to those skilled in the art upon reading the following detailed description of the embodiments, and by referring to the accompanying drawings.

Referring now to FIG. 1, pipe storage and handling system 100 comprises moveable storage rack 102, stationary frame 104, tilting frame 106, elevated stop 108, and pipe unloading assembly 110. Pipe unloading assembly 110 comprises lifting arm or block 114 and rotating arm 116. Tilting frame 106 is pivotally coupled to stationary frame 104 at pivot 118. Rack 102 is moveably coupled to tilting frame 106 via elevation mechanism 134 so that the rack is vertically moveable relative to frames 104 and 106. Pipe cartridge 120 is disposed on rack 102 and supports a plurality of pipes 122, or other tubular members. Pipe cartridge 120 comprises an L-shaped frame 124 and one or more moveable retainers 126. Moveable retainer 126 comprises an L-shaped member having a first portion 125 coupled to the frame 124 and a second portion 127 generally vertically disposed in the position shown. Pipe handling system 100 is shown in a loading position, wherein pipes are generally at a storage end in cartridge 120 below a loading end generally at stop 108 or arm 116.

Pipe handling system 100 is disposed adjacent to an erector system 400 that moves pipes 122 between a horizontal position and an inclined or vertical position where the pipes are passed off to a drilling rig or other equipment. Embodiments of erector systems can be found in U.S. patent application Ser. No. 11/458,520 (Single Joint Drilling System with Inclined Pipe Handling), U.S. patent application Ser. No. 11/458,527 (Horizontal Pipe Handling System), and U.S. patent application Ser. No. 11/458,534 (Single Joint Drilling System). In general, erector system 400 comprises rotating gripping arms 402 mounted to moveable arm 404 so as to secure a tubular member to the moveable arm during handling.

Figure 2:
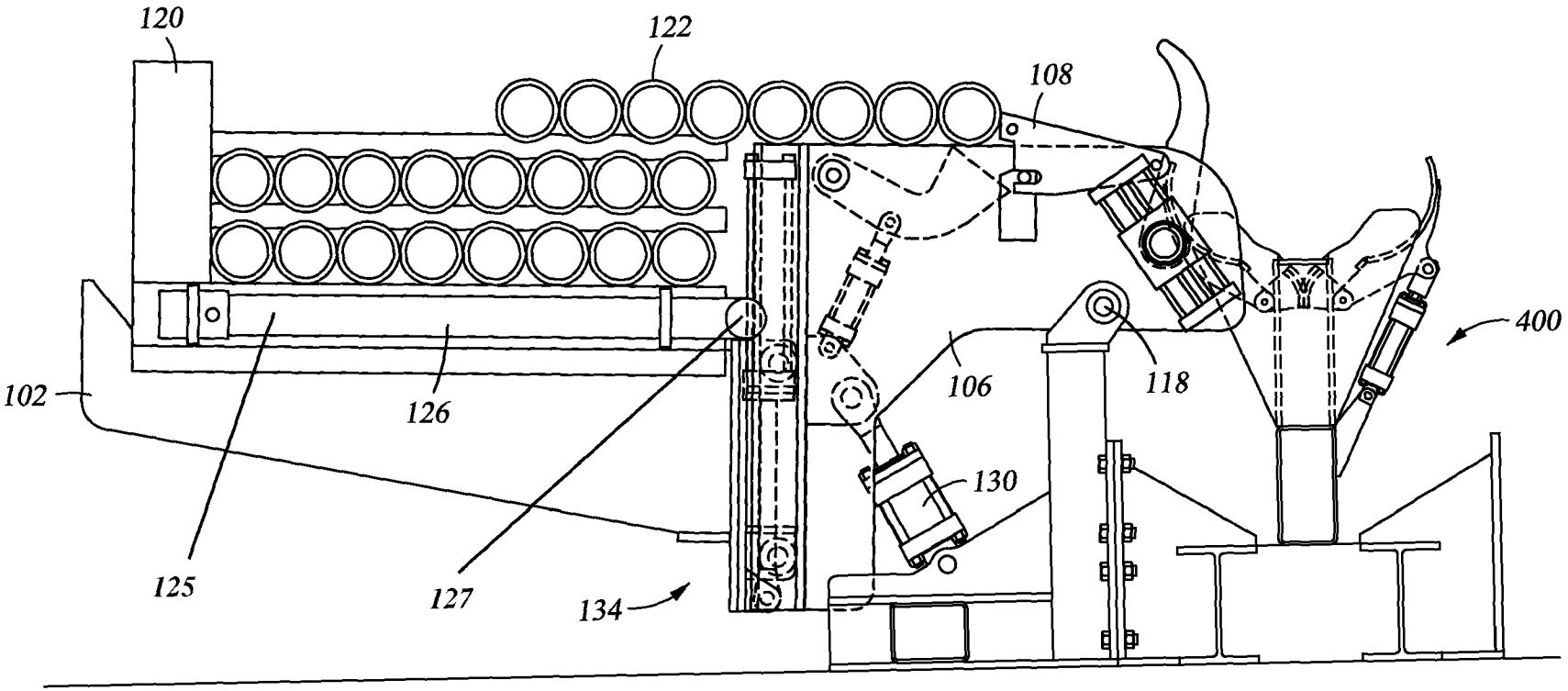
FIG. 2 is the pipe storage and handling system of FIG. 1 shown in a first pipe-unloading configuration.
Figure 3:
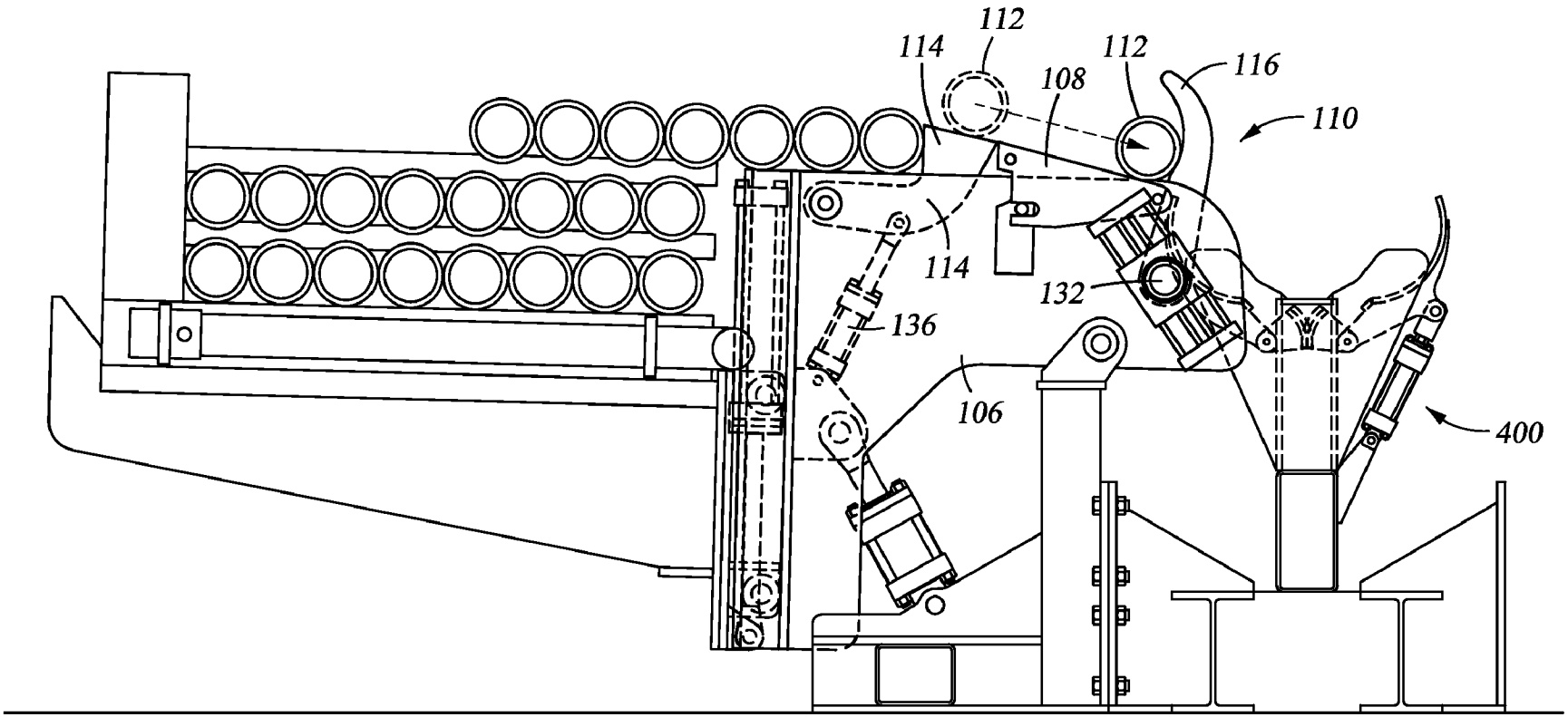
FIG. 3 is the pipe storage and handling system of FIG. 1 shown in a second pipe-unloading configuration.
Figure 4:
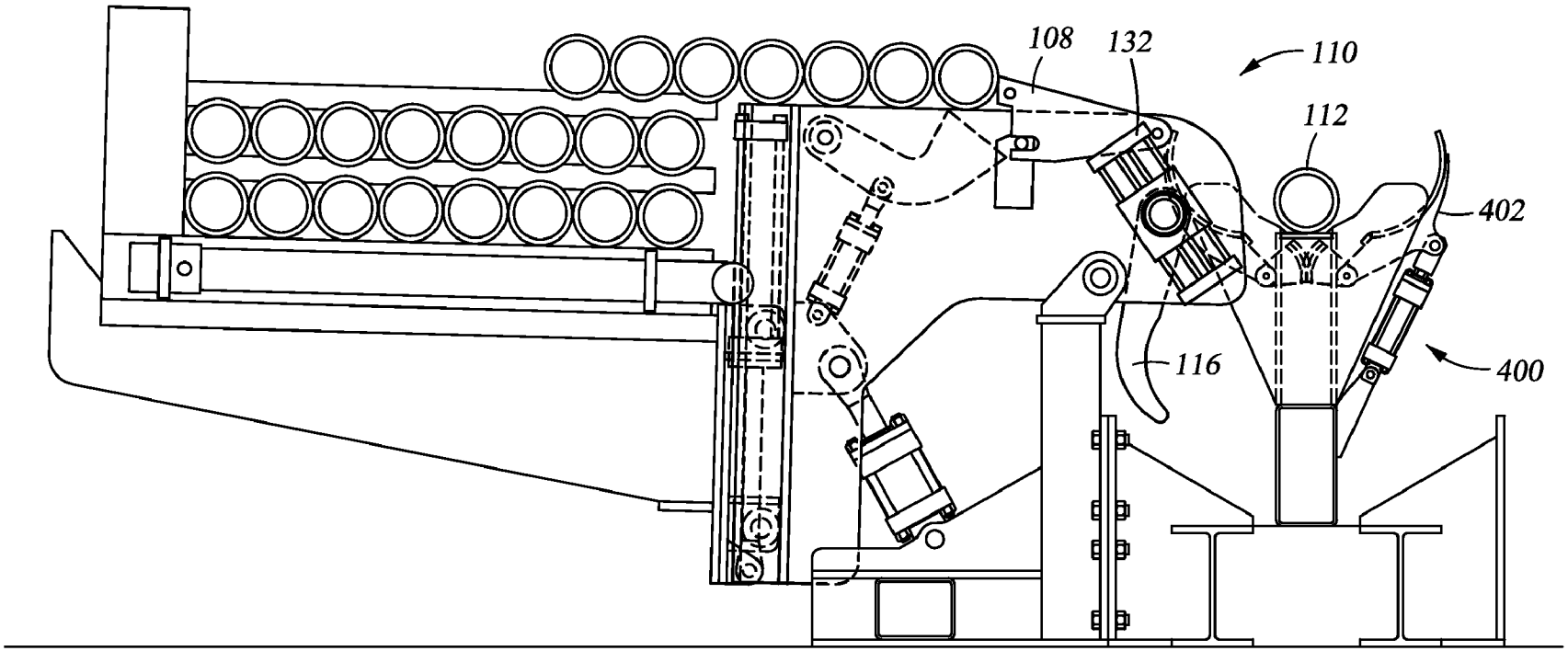
FIG. 4 is the pipe storage and handling system of FIG. 1 shown in a third pipe-unloading configuration.

FIGS. 2-4 illustrate the movement of pipes 122 from pipe cartridge 120 to erector system 400. Referring now to FIG. 2, tilting frame 106 is rotated about pivot 118 by actuator 130 so that rack 102 and cartridge 120 elevate the top row of pipes 122 at the storage end above both the loading end of system 100 and erector system 400. System 100 is generally in an unloading position. Retainer 126 can be moved to a retracted position by moving or rotating the second portion 127 while the first portion 125 is coupled to the frame 124. As shown, the second portion 127 may be moved or retracted to a generally horizontal position. Once retainer 126 is moved to a retracted position, gravity will move pipes 122 from a storage end in cartridge 120 and along cartridge 120 toward tilting frame 16 until the pipes contact a loading end at elevated stop 108. As a row of pipes 122 are moved, elevator 134 moves rack 102 upward so that the next row of pipes can move out of cartridge 120.

Referring now to FIG. 3, to load a single joint of pipe 112 onto erector system 400, lifting block 114 is raised by an actuator 136, pushing a single joint of pipe 112 upward. The pipe 112 moves over and past elevated stop 108 toward the end of frame 106. Lifting block 114 is then lowered so that the remainder of pipes 120 can move downward until contacting elevated stop 108.

At the end of frame 104, pipe 112 is stopped by arm 116, which is disposed in a raised position. Arm 116 is coupled to rotary motor 132 that rotates the arm until pipe 112 is lowered onto erector system 400 as is shown in FIG. 4. Arm 116 continues rotating downward so that is out of the way of erector system 400. Erector system 400 can then lift pipe 112 upward and away from pipe handling system 100.

Figure 5:
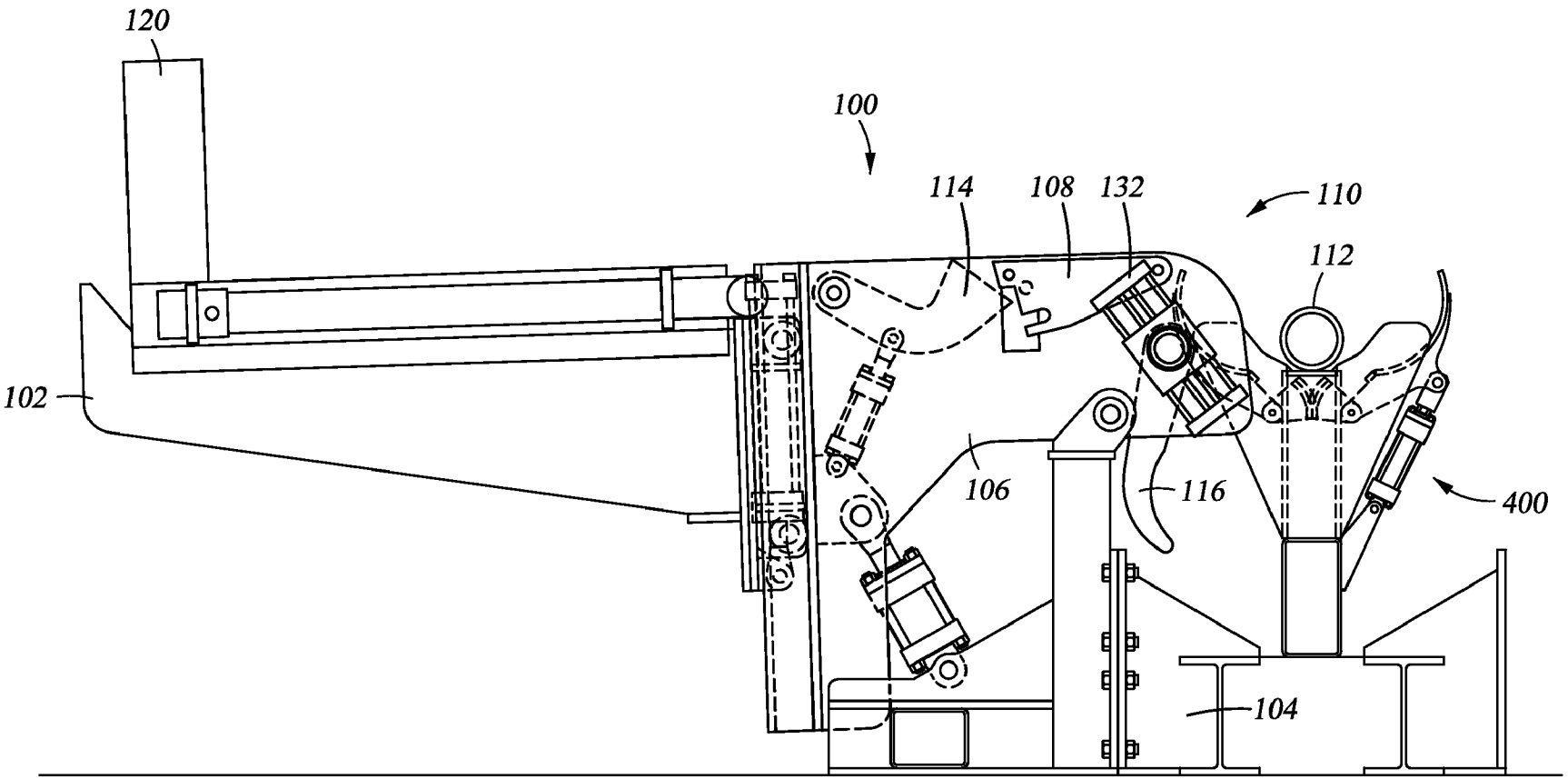
FIG. 5 is the pipe storage and handling system of FIG. 1 shown in a first pipe-loading configuration.
Figure 6:
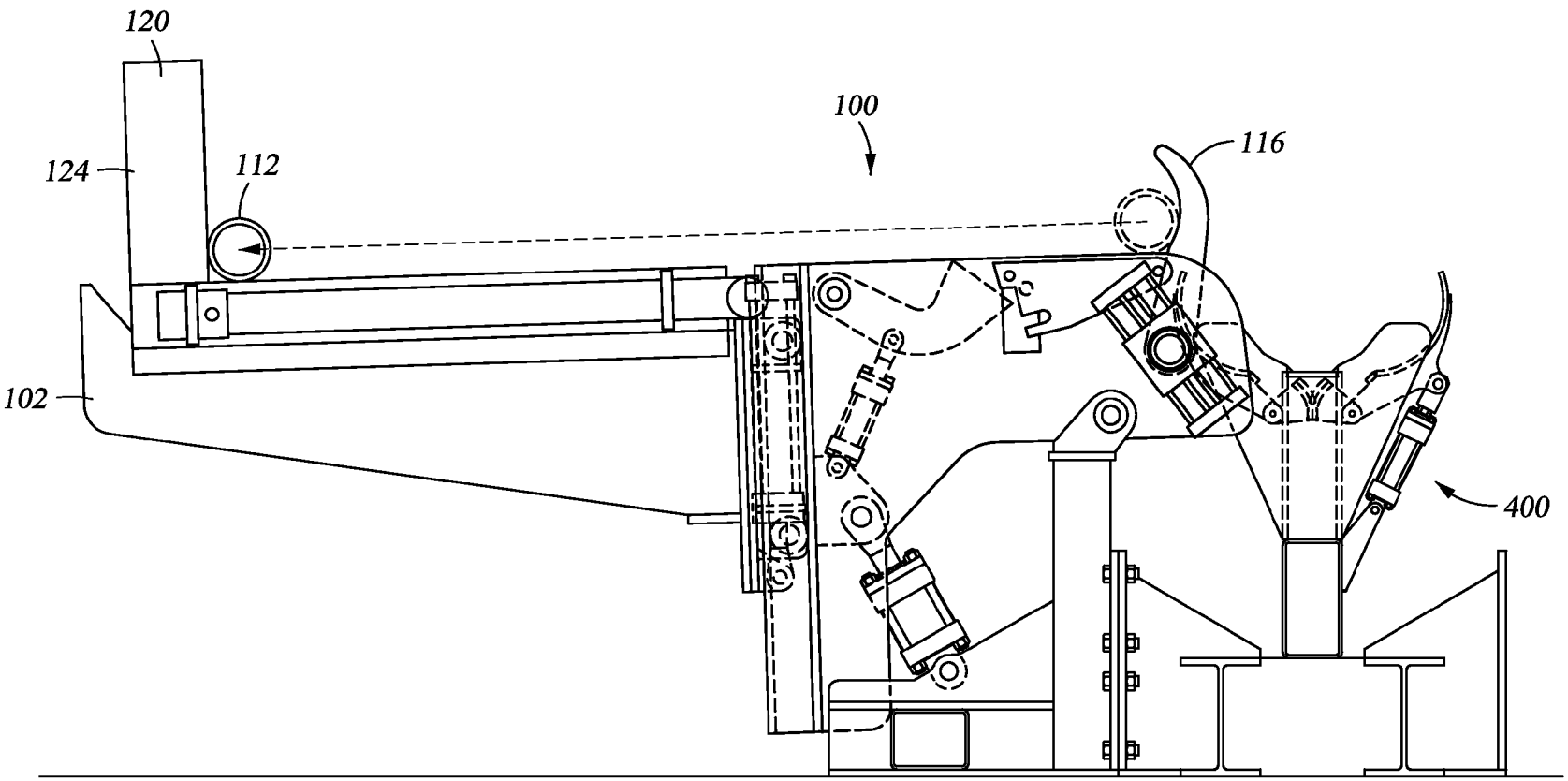
FIG. 6 is the pipe storage and handling system of FIG. 1 shown in a second pipe-loading configuration.

FIGS. 5 and 6 illustrate pipe handling system 100 being used to move pipes back onto cartridge 120. When moving pipes 112 from erector system 400, rack 102 is lowered so that cartridge 120 is below the top of tilting frame 106. Lifting block 114 and elevated stop 108 are retracted into tilting frame 106 so as to provide a smooth surface along which pipe 112 can roll, as shown in FIG. 5. Once pipe 112 is lowered and released by erector system 400, arm 116 rotates upward so as to lift the pipe from the erector. Arm 116 continues to rotate until pipe 112 falls onto tilting frame 106 where it rolls onto cartridge 120, as shown in FIG. 6. As a row of pipes 112 are loaded onto cartridge 120, rack 102 is lowered so that additional rows of pipes can be loaded.

Figure 7:
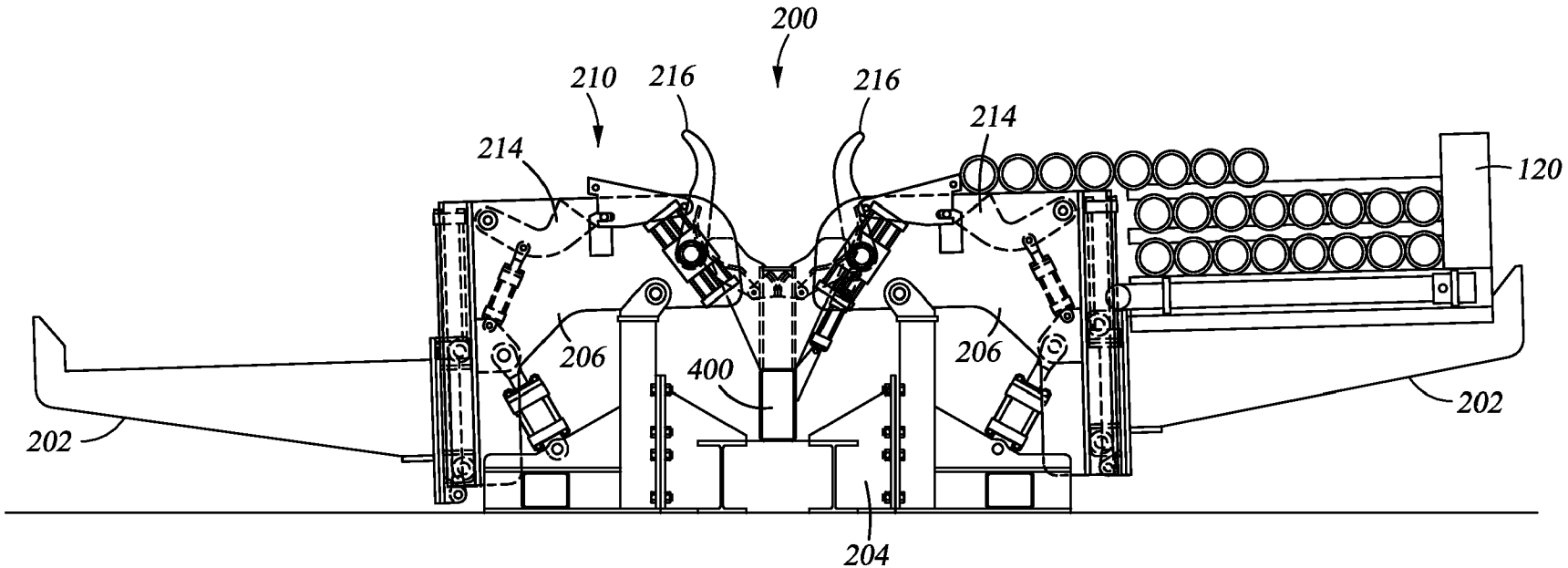
FIG. 7 is a pipe storage and handling system constructed in accordance with embodiments of the present invention.

FIG. 7 illustrates one embodiment of a pipe handling system 200 comprising opposing racks 202 and tilting frames 206 coupled to a stationary frame 204. Each tilting frame 206 supports a pipe unloading assembly 210 that comprises a lifting block 214 and a rotating arm 216. Pipe erector 400 can be disposed in the middle of pipe handling system 200 so that pipe can be loaded from both sides of the erector system. Pipe handling system 200 allows two cartridges 120 to be loaded simultaneously, thus allowing for continuous loading/unloading operations as pipe can be loaded or unloaded from one cartridge while the other cartridge is being replaced. Each set of tilting frames 206, racks 202 and pipe unloading assemblies 210 operate consistently with the disclosure herein.

Figure 8:
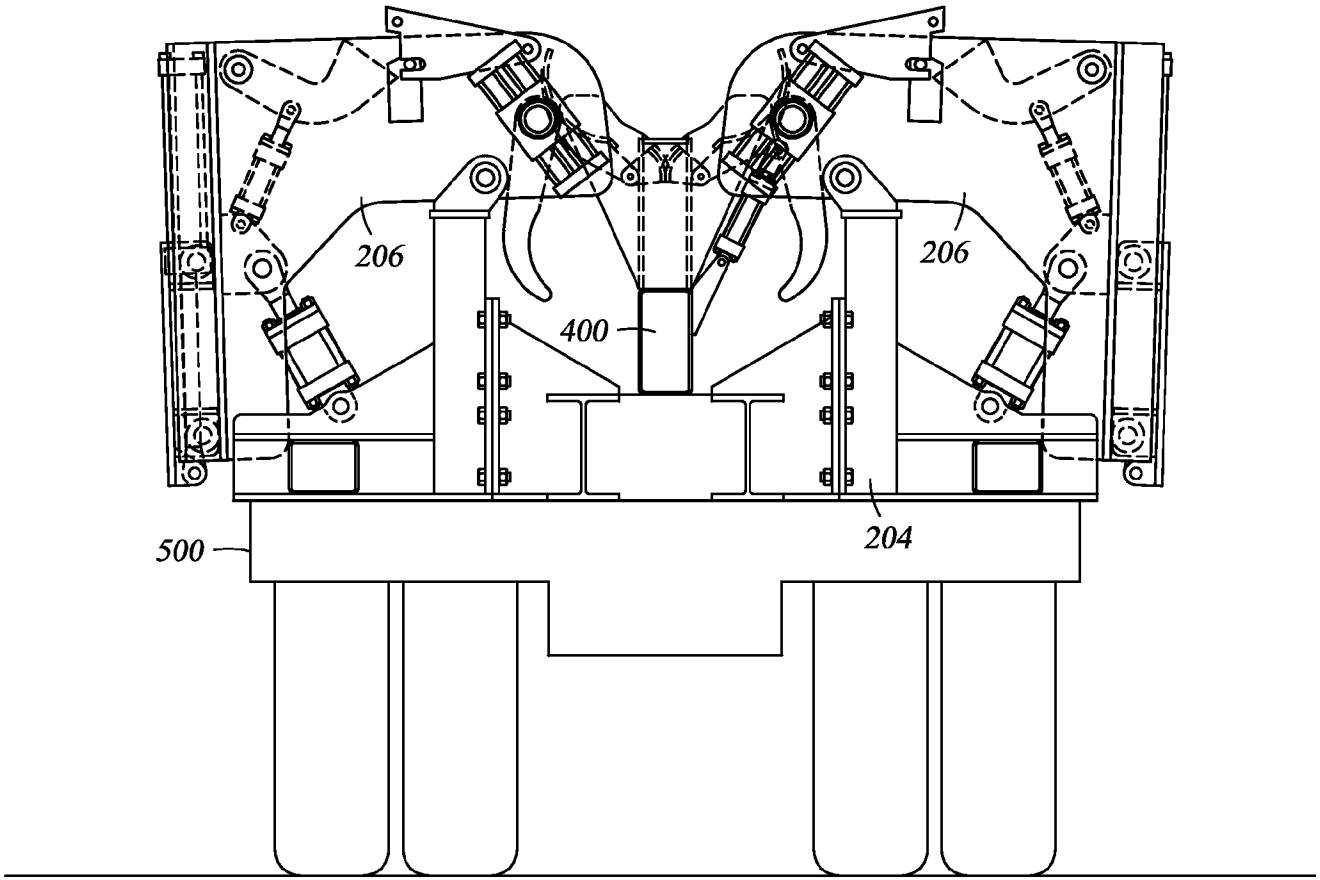
FIG. 8 is the pipe storage and handling system of FIG. 7 in a transportation configuration.

In order to transport pipe handling system 200, racks 202 can be removed so that stationary frame 204 can be transported on a single trailer 500 along with tilting frames 206 and erector 400, as shown in FIG. 8. Once at a worksite, racks 202 are reattached and cartridges 120 can be loaded.

Figure 9:
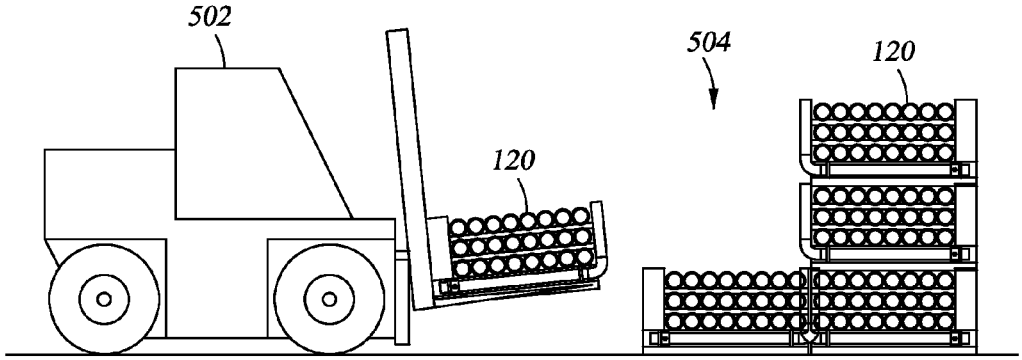
FIG. 9 illustrates the storage of pipe cartridges in stacks.
Figure 10:
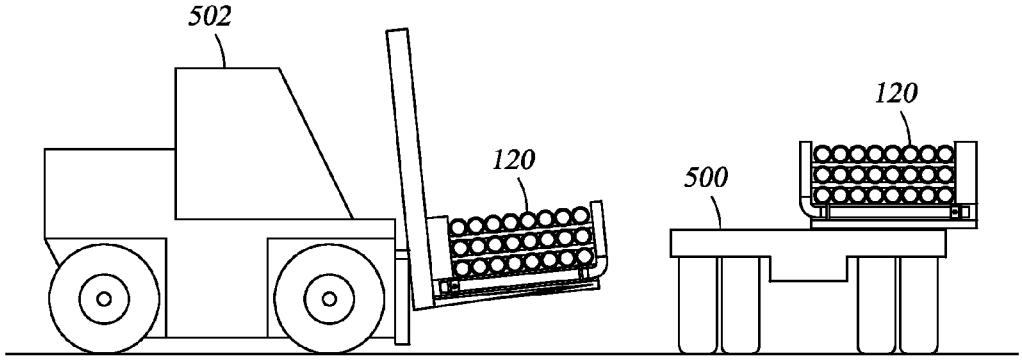
FIG. 10 illustrates the transportation of pipe cartridges on trailers.

Pipe cartridges 120 provide a modular system for storing, handling, and transporting pipe. As shown in FIGS. 9 and 10, pipe cartridges 120 are preferably sized so as to be easily transported by forklift 502. Cartridges 120 can be stored in stacks 504 or loaded onto trailers 500 for transport. Because the individual pipes are only removed from and loaded onto cartridges 120 by a pipe handling system 100, 200, the use of cartridges minimizes the need to handle individual pipes and therefore improves safety in the pipe handling process.

Figure 11:
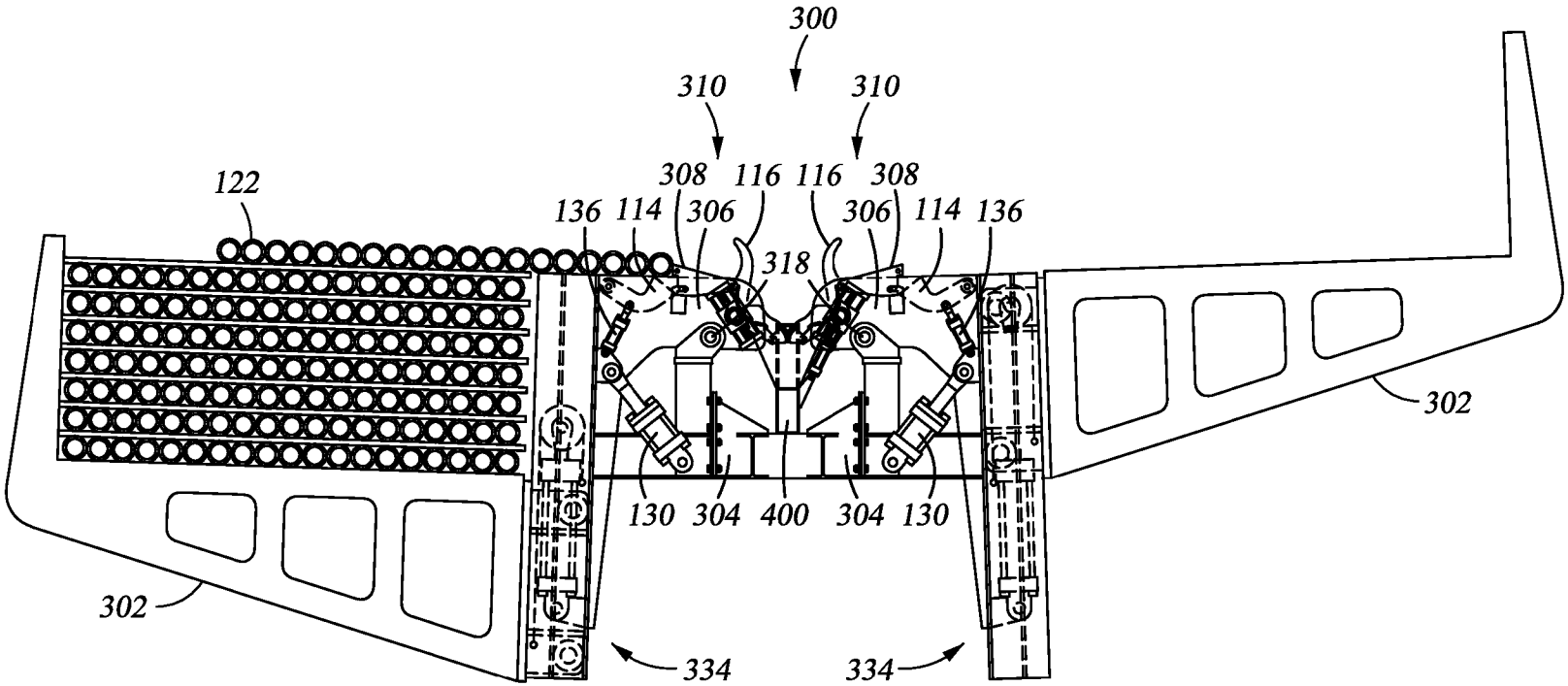
FIG. 11 is a pipe storage and handling system constructed in accordance with embodiments of the present invention.

FIG. 11 shows an alternate pipe handling system 300 that does not utilize a cartridge system. Pipe handling system 300 comprises one or more moveable racks 302, stationary frame 304, tilting frames 306, elevated stops 308, and pipe unloading assemblies 310. Pipe unloading assemblies 310 comprise lifting blocks 114 and rotating arms 116. Tilting frames 306 are pivotally coupled to stationary frame 304 at pivots 318. Racks 302 are moveably coupled to tilting frames 306 via elevators 334 so that the racks are vertically moveable relative to the tilting frame. Racks 302 are substantially L-shaped so as to hold a plurality of pipes 122.

Pipe handling system 300 operates in the same manner described above in relation to systems 100 and 200 but does not utilize pipe cartridges 120. Pipe handling system 300 is sized so as to hold a larger quantity of pipe so that a sufficient amount of pipe is stored within racks 302. Pipe handling system 300 may be especially useful in operations where it is impractical or unnecessary to move smaller quantities of pipe to and from the system during operations.

Horizontal pipe storage and handling systems can be used with a variety of pipe erectors and other pipe handling systems. For example, a horizontal pipe handling system may be utilized to move pipes onto and off of a pipe erector that moves the pipe from the horizontal storage position to a drill floor. Horizontal pipe handling systems can also be used with conventional pipe hoisting systems as well as other handling systems. Horizontal pipe handling systems may operate as separate components within a drilling system or be combined into an integrated system with a pipe erector or hoisting system. It is also understood that horizontal pipe handling systems can be used with a variety of oilfield tubulars, including drill pipe, drill collars, casing, and tubing.

While preferred embodiments of this invention have been shown and described, modifications thereof can be made by one skilled in the art without departing from the scope or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. An oilfield pipe storage and handling system comprising:

a stationary frame disposed near a drilling rig;

a tilting frame moveably coupled to said stationary frame and having a loading end;

a pipe rack moveably coupled to said tilting frame and configured to support a plurality of oilfield pipes at a storage end, wherein said tilting frame is moveable between a loading position where said loading end is positioned at a higher elevation than said storage end and an unloading position wherein said storage end is positioned at a higher elevation than said loading end;

an elevation mechanism coupled between said pipe rack and said tilting frame, wherein said elevation mechanism is operable to move said pipe rack relative to said tilting frame;

an arm disposed at said loading end of said tilting frame, wherein said arm is configured to engage a single oilfield pipe and move said single oilfield pipe onto or off of said tilting frame; and a cartridge supported by said pipe rack, wherein said cartridge comprises a frame supporting adjacent rows of oilfield pipes and a vertical retainer having a first portion coupled to the frame and a second portion that is retractable while the first portion is coupled to the frame to allow for successive rows of oilfield pipes to be rolled onto and off of the cartridge.

2. The oilfield pipe storage and handling system of claim 1 further comprising a tilting mechanism coupled between said stationary frame and said tilting frame, wherein said tilting mechanism is operable to move said tilting frame from the loading position to the unloading position about a pivot.

3. The oilfield pipe storage and handling system of claim 1 wherein said elevation mechanism is operable to maintain a top row of said oilfield pipes at said loading end elevated higher than said storage end in said loading position.

4. The oilfield pipe storage and handling system of claim 1 wherein said elevation mechanism is operable to maintain a top row of said oilfield pipes at said storage end elevated higher than said loading end in said unloading position.

5. The oilfield pipe storage and handling system of claim 1 wherein said frame is an L-shaped frame that opposes an L-shaped member of said vertical retainer to capture said oilfield pipes in said cartridge.

6. The oilfield pipe storage and handling system of claim 1 further comprising a lifting mechanism coupled to said tilting frame and operable to separate said single oilfield pipe from said plurality of oilfield pipes.

7. The oilfield pipe storage and handling system of claim 6 wherein said lifting mechanism comprises a lifting block that pushes said single oilfield pipe upward and over an elevated stop disposed on said tilting frame.

8. The oilfield pipe storage and handling system of claim 1 wherein said arm is rotatably coupled to said loading end of said tilting frame.

9. The oilfield pipe storage and handling system of claim 8 wherein said arm rotates in a first direction of rotation when said tilting frame is in said loading position and in a second direction of rotation when said tilting frame is in said unloading position.

10. The oilfield pipe storage and handling system of claim 8 further comprising a rotary motor coupled to and operable to rotate said arm.

11. The oilfield pipe storage and handling system of claim 1 wherein said cartridge is removable and transportable to and from said pipe rack.

12. An oilfield pipe storage and handling system comprising:

a pipe erector disposed near a drilling rig;

a stationary frame disposed adjacent to said pipe erector;

a tilting frame moveably coupled to said stationary frame and having a loading end;

a pipe rack moveably coupled to said tilting frame by an elevation mechanism operable to move said pipe rack vertically relative to said tilting frame, said pipe rack configured to support a plurality of oilfield pipes at a storage end, wherein said tilting frame and said pipe rack are moveable to transfer said oilfield pipes between said storage end and said loading end;

an arm disposed at said loading end of said tilting frame, wherein said arm is configured to engage a single pipe and move said single pipe onto or off of said pipe erector; and a cartridge supported by said pipe rack, wherein said cartridge comprises a frame supporting adjacent rows of oilfield pipes and a vertical retainer having a first portion coupled to the frame and a second portion that is retractable while the first portion is coupled to the frame to allow for successive rows of oilfield pipes to be rolled onto and off of the cartridge.

13. The oilfield pipe storage and handling system of claim 12 further comprising a tilting mechanism coupled between said stationary frame and said tilting frame, wherein said tilting mechanism is operable to move said tilting frame from the loading position to the unloading position about a pivot.

14. The oilfield pipe storage and handling system of claim 12 further comprising a lifting mechanism coupled to said tilting frame and operable to separate said single oilfield pipe from said plurality of oilfield pipes.

15. The oilfield pipe storage and handling system of claim 12 wherein said arm is rotatably coupled to said loading end of said tilting frame via a rotary motor that is operable to rotate said arm in a first direction of rotation when said tilting frame is in said loading position and in a second direction of rotation when said tilting frame is in said unloading position.

16. The oilfield pipe storage and handling system of claim 12 wherein said cartridge is removable to and from any one or more of a stack of cartridges or a trailer.

17. A method for handling oilfield pipes comprising:

storing a plurality of oilfield pipes in a pipe cartridge in adjacent rows that are retained on a pipe cartridge frame by a vertical retainer, the vertical retainer having a first portion coupled to the frame and a second portion;

loading the pipe cartridge onto a pipe rack between a storage end of the pipe rack and a loading end of a tilting frame that is moveably coupled to a stationary frame;

moving the tilting frame and the pipe rack that is moveably coupled to a second end of the tilting frame to an unloading position wherein the storage end is positioned at a higher elevation than the loading end;

retracting the second portion of the vertical retainer while the first portion is coupled to the frame of the pipe cartridge to release successive rows of the oilfield pipes in the pipe cartridge;

moving the pipe rack relative to the tilting frame and along the second end to maintain a top row of the oilfield pipes in the pipe cartridge at the storage end above the loading end; and rotating an arm disposed at the loading end of the tilting frame so that the arm engages a single oilfield pipe and moves the single oilfield pipe off of the tilting frame.

18. The method of claim 17 further comprising:

moving the tilting frame to a loading position wherein the loading end is positioned at a higher elevation than the storage end; and rotating the arm to engage the single oilfield pipe and move the single oilfield pipe onto the tilting frame.

19. The method of claim 18 further comprising:

moving the pipe rack relative to the tilting frame in an opposite direction along the second end to maintain a top row of oilfield pipes at the storage end below the loading end; and replacing the retainer to contain the oilfield pipes in the pipe cartridge.

20. The method of claim 19 further comprising transporting the pipe cartridge from any one or more of a stack of cartridges or a trailer and then loading the pipe cartridge onto the pipe rack.

21. The method of claim 17 further comprising transporting the pipe cartridge from the pipe rack to any one or more of a stack of cartridges or a trailer.

* * * * *